US008773008B2

(12) United States Patent
Ito et al.

(10) Patent No.: US 8,773,008 B2
(45) Date of Patent: Jul. 8, 2014

(54) DISCHARGE LAMP BULB HAVING METAL BAND SUPPORTED BY SUPPORT PORTION

(75) Inventors: Yoshiro Ito, Shizuoka (JP); Toshiaki Tsuda, Shizuoka (JP); Kunio Fukai, Shizuoka (JP); Masaya Shido, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 79 days.

(21) Appl. No.: 13/420,328

(22) Filed: Mar. 14, 2012

(65) Prior Publication Data

US 2012/0235563 A1 Sep. 20, 2012

(30) Foreign Application Priority Data

Mar. 15, 2011 (JP) ..... 2011-056241

(51) Int. Cl.
*H01J 61/36* (2006.01)
*H01J 5/48* (2006.01)

(52) U.S. Cl.
USPC ..... 313/318.09; 313/623

(58) Field of Classification Search
USPC ..... 313/17, 25, 26, 318.01–318.05, 313/318.08–318.11, 634, 635
See application file for complete search history.

(56) References Cited

U.S. PATENT DOCUMENTS 5,742,114 A * 4/1998 Kohl et al. ..... 313/318.01
2002/0130601 A1* 9/2002 Tsuda et al. ..... 313/110
2004/0130255 A1* 7/2004 Mudra et al. ..... 313/318.08
2011/0037374 A1* 2/2011 Gerhard et al. ..... 313/318.01

FOREIGN PATENT DOCUMENTS

JP 2003-123630 A 4/2003

* cited by examiner

*Primary Examiner* — Nimeshkumar Patel
*Assistant Examiner* — Steven Horikoshi
(74) *Attorney, Agent, or Firm* — Sughrue Mion, PLLC

(57) ABSTRACT

A discharge lamp bulb includes an arc tube having: a pair of electrodes that are opposed to each other inside a luminous tube; an outer tube having the luminous tube therein; a pair of lead wires connected to the electrodes; and a metal band mounted on an outer periphery of the outer tube, a support plug having: a plug body having a hollow, inner cylindrical section therein that opens at a front end; an arc-tube support portion mounted on a front-end edge of the inner cylindrical section; and a flange, and a lead support wire extending outside the outer tube in the longitudinal direction and connecting one of the lead wires with the support plug, wherein a front-end face of the inner cylindrical section is substantially flush with a front-end face of the flange or positioned on a back-end side with respect to the front-end face of the flange.

5 Claims, 5 Drawing Sheets

FIG. 4

| BULB AND LAMP PERFORMANCE | | | | |
|---|---|---|---|---|
| | | CONVENTIONAL BULB | BULB OF FIG.3 | BULB OF FIG.2 |
| LCL(mm) | | 27.1 | 18 | 18 |
| 35W | BULB LUMINOUS FLUX(lm) | 3200 | 2970 | 3120 |
| | LAMP LUMINOUS FLUX(lm) | 1100 | 900 | 1080 |
| | CENTER LUMINOUS INTENSITY(cd) | 69000 | 50000 | 68800 |
| 25W | BULB LUMINOUS FLUX(lm) | 2150 | 1990 | 2100 |
| | LAMP LUMINOUS FLUX(lm) | 740 | 600 | 730 |
| | CENTER LUMINOUS INTENSITY(cd) | 44160 | 31900 | 44000 |

DISCHARGE LAMP BULB HAVING METAL BAND SUPPORTED BY SUPPORT PORTION

INCORPORATION BY REFERENCE

The disclosure of Japanese Patent Application No. 2011-056241 filed on Mar. 15, 2011 including the specification, drawings and abstract is incorporated herein by reference in its entirety.

BACKGROUND OF THE INVENTION

1. Field of the Invention

The invention relates to a discharge lamp bulb that is used in a vehicle headlight or the like.

2. Description of Related Art

Japanese Patent Application Publication No. 2003-123630 (JP 2003-123630 A) discloses, as shown its FIG. 1 through FIG. 3, a discharge lamp bulb (discharge lamp device) that includes an arc tube body in which an arc tube where a pair of opposing electrodes are disposed inside a sealed glass bulb is formed inside a shroud glass in one body and an insulating plug which holds the arc tube body through a metal perpendicularly holding member. The arc tube emits light with a luminescent material that is filled inside the sealed glass bulb and electrodes, and the outgoing light from the center of the sealed glass bulb is reflected forward by a reflector that is arranged to the rear of the sealed glass bulb obliquely above the sealed glass bulb. An amount of light reflected by the reflector increases as an angle that is formed by a straight line passing through a luminescent center of a luminous tube and perpendicular to a central axis of the luminous tube and a straight line passing through the luminescent center and an innermost edge of the reflector (maximum angle of incidence of the light that goes from the luminescent center toward the reflector) increases.

In recent years, since further size and weight reductions for vehicle headlights are demanded, further size reduction for the discharge lamp bulb is also demanded. The size reduction for the discharge lamp bulb can be achieved by shortening the length of the arc tube body that is shown in FIG. 2 of JP 2003-123630 A.

However, when projecting length of the arc tube body from the insulating plug is shortened, the luminescent center of the arc tube body shown in the drawing is arranged closer to the insulating plug than that of the arc tube body that is shown in FIG. 2 of JP 2003-123630 A. As a result, in the discharge lamp device in the drawing, the incident angle from the luminescent center to the reflector decreases, and therefore the amount of light reflected by the reflector decreases as compared to that of the discharge lamp bulb that is disclosed in JP 2003-123630 A.

Furthermore, when the luminescent center of the arc tube body is arranged closer to the insulating plug, because part of the outgoing light from the arc tube body to the reflector is blocked by a tab piece of the metal perpendicularly holding member or the insulating plug in the discharge lamp bulb, the amount of light reflected by the reflector is reduced.

SUMMARY OF THE INVENTION

The invention provides a discharge lamp bulb, with which it is possible to adequately maintain a specified amount of light reflected by a reflector even if the size is reduced by shortening projecting length of an arc tube from an insulating plug.

A discharge lamp bulb according to an aspect of the invention includes an arc tube having: a luminous tube, both ends of which are sealed; a pair of electrodes that are disposed inside the luminous tube so as to be opposed to each other; an outer tube that has the luminous tube therein and both ends of which are sealed; a pair of lead wires that are connected to the pair of electrodes and respectively extend outward from ends of the outer tube in a longitudinal direction of the discharge lamp body; and a metal band that is mounted on an outer periphery of the outer tube, an arc tube support plug including: a plug body having a hollow, inner cylindrical section that is formed inside the plug body and that opens at a front end; a support portion that is mounted on a front-end edge of the inner cylindrical section and supports the arc tube by holding the metal band; and a flange for mounting a reflector, and a lead support wire extending outside the outer tube in the longitudinal direction and connecting one of the pair of lead wires with the arc tube support plug, wherein a front-end face at the front-end edge of the inner cylindrical section is substantially flush with a front-end face of the flange or is positioned on a back-end side with respect to the front-end face of the flange.

In the discharge lamp bulb of the above aspect, a front-end face at a front-end edge of the arc tube support plug that is conventionally formed to protrude stepwise forward from a reflector mounting flange is disposed at a position that is substantially flush with a front-end face of the flange, which serves as an attachment reference surface of the discharge lamp bulb, or on a back-end side with respect to the front-end face of the flange.

As a result, in the discharge lamp bulb of the above aspect, the light emitted from the luminescent center of the luminous tube to the reflector is incident on the reflector that is disposed to the rear of the luminous tube obliquely above the luminous tube, without being blocked by the front-end face at the front-end edge of the arc tube support plug. In addition, since the front-end edge of the inner cylindrical section of the arc tube support plug is disposed away from the luminescent center, if the arc tube support plug contains resin components, the arc tube support plug that reaches high temperature when the discharge lamp bulb is lit becomes less prone to generate gas.

According to the discharge lamp bulb of the above aspect, a small discharge lamp bulb in which the amount of light reflected by the reflector is adequately maintained is obtained even if the arc tube is shortened, and therefore it is possible to reduce the size and the weight of the light that uses the discharge lamp bulb of the invention. In addition, discoloration of the reflector due to gas is prevented.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 4 is a table that shows comparison data of luminous fluxes of arc tubes in a conventional technique and the invention.

DETAILED DESCRIPTION OF EMBODIMENTS

Figure 1:
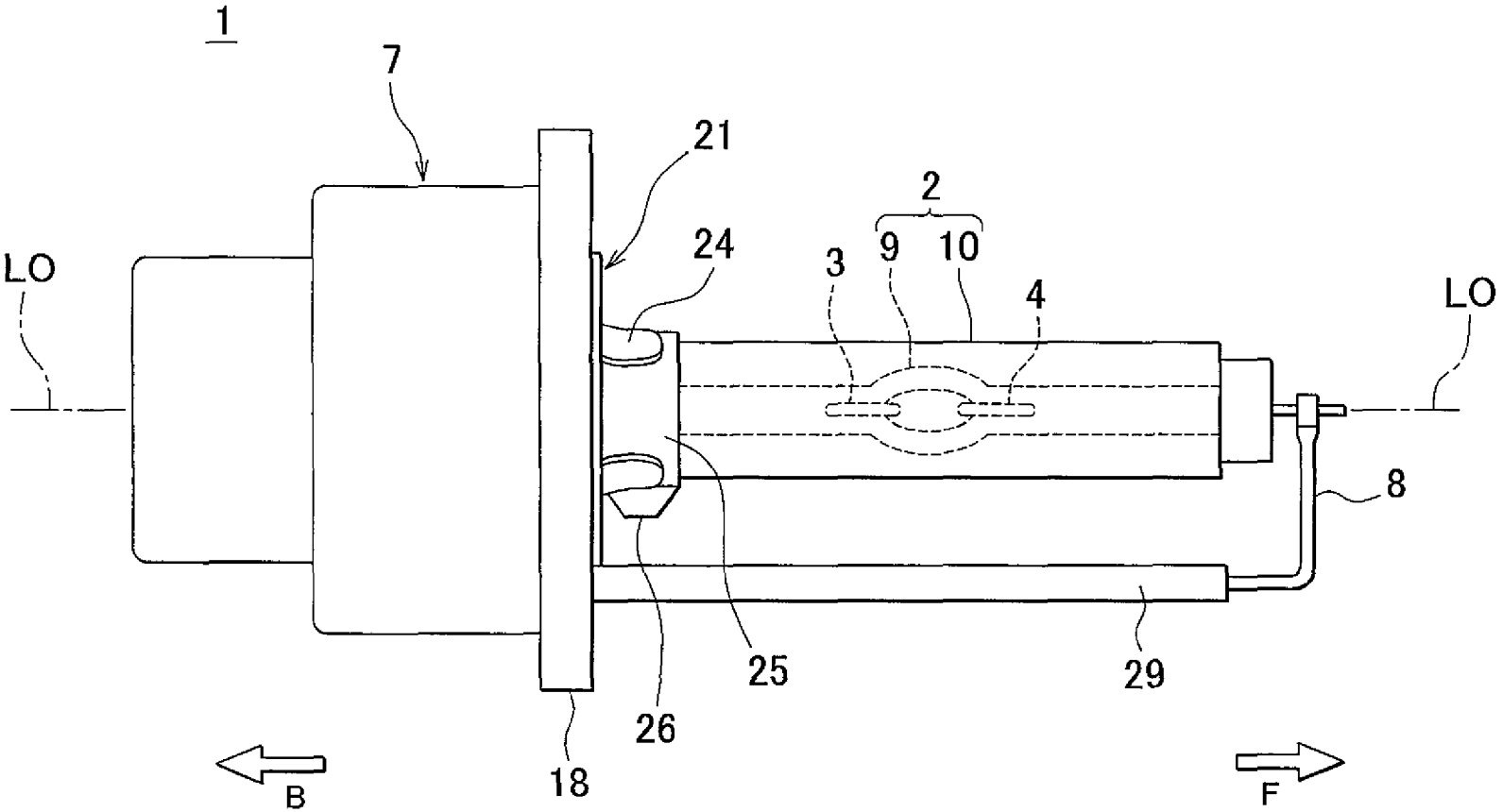
FIG. 1 is a side view of a discharge lamp bulb of a first embodiment.
Figure 2:
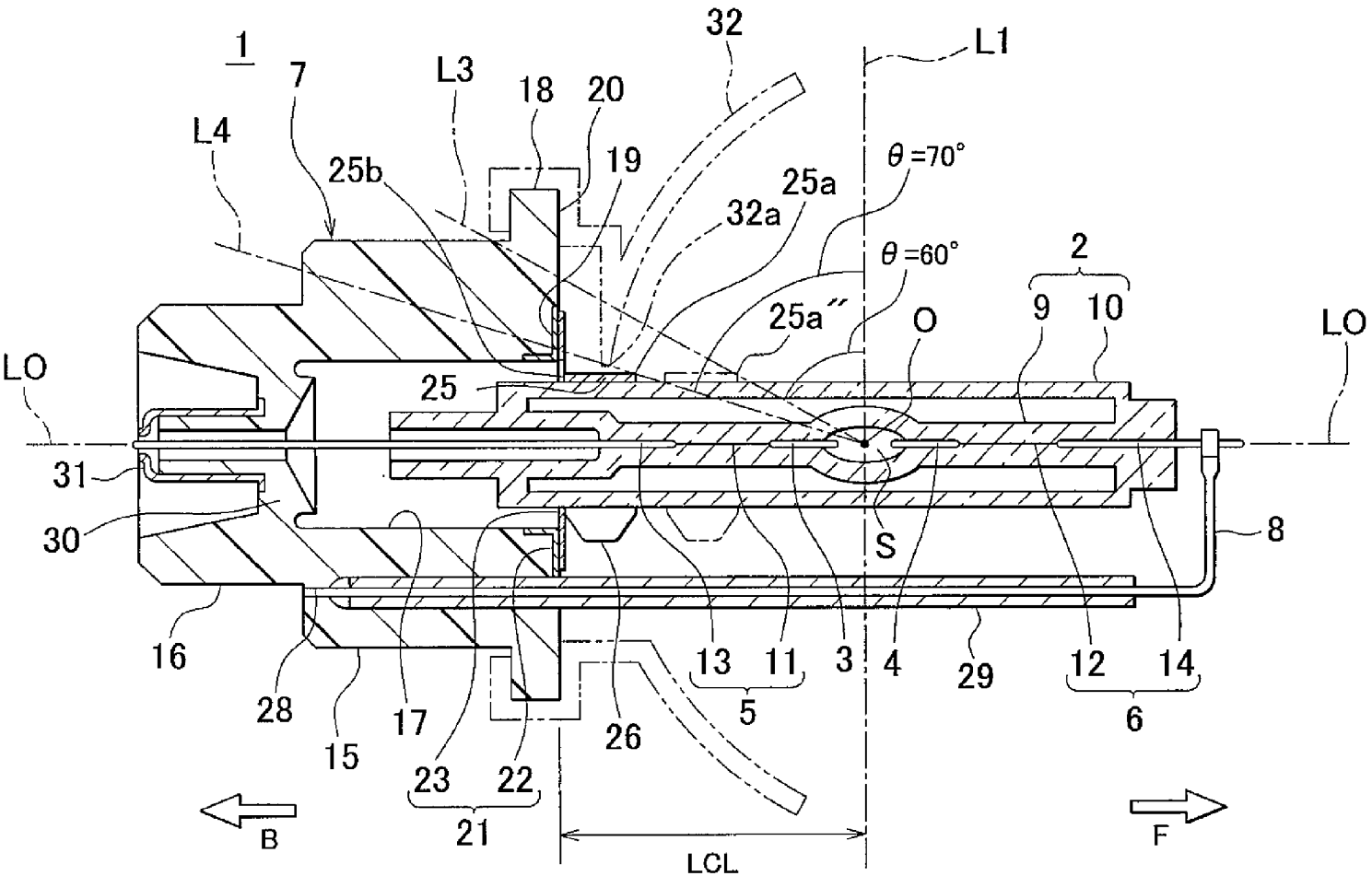
FIG. 2 is a longitudinal section of the discharge lamp bulb shown in FIG. 1.

First, a discharge lamp bulb according to a first embodiment of the invention will be described with reference to FIG. 1 and FIG. 2. The discharge lamp bulb 1 of the first embodiment has an arc tube 2, electrodes 3 and 4, lead wires 5 and 6, an arc tube support plug 7, and a lead support wire 8. In the invention, as shown in FIGS. 1 through 3 and FIG. 5, a right-hand side of the drawing, that is, the tip, or distal, end side of the discharge lamp bulb is defined as the front side (reference symbol F) and a left-hand side of the drawing, that is, the base, or proximal, end side of the discharge lamp bulb is defined as the back side (reference symbol B).

The arc tube 2 is formed by integrating a luminous tube 9 with an outer tube 10 into one body with the luminous tube 9 being disposed in the outer tube 10. Both of the luminous tube 9 and the outer tube 10 are made of silica glass and are coaxially arranged (central axis L0). The luminous tube may be made of translucent ceramics such as polycrystalline alumina, and the outer tube may be made of hard glass. A center section of the luminous tube 9 has a spheroidal shape about the central axis L0, and a discharge light emission chamber S is formed inside the center section.

Each of the lead wires 5 and 6 is formed with metal foil 11 and 12 and a lead wire body 13 and 14 that is connected to one end of the metal foil, and the electrode 3 and 4 that is made of tungsten is connected to the other end of the metal foil. The electrodes 3 and 4 and the lead wires 5 and 6 are disposed inside the luminous tube 9, and the electrode 3 and 4 are fixed in the luminous tube 9 in a state where tips of the electrodes are disposed to be opposed to each other in the discharge light emission chamber S. The discharge light emission chamber S is filled with the luminescent material inside and pinch-sealed at the positions of arrangement of the metal foil 11 and 12.

In addition, the arc tube 2 is supported by the arc tube support plug 7. The arc tube support plug 7 has a cylindrical plug body 15 and a base end section 16 that has a smaller diameter than the plug body and the plug body and the base end section are continuously shaped in the longitudinal direction. An inner cylindrical section 17 that opens at a front end is formed inside the plug body 15. A flange 18 is formed at a front-end side outer periphery of the plug body 15. A front-end face 19 at a front-end edge portion of the inner cylindrical section 17 is formed to be substantially flush with a front-end face 20 of the flange 18, which serves as an attachment reference surface of the discharge lamp bulb.

In addition, a metal support 21 that supports the arc tube is integrally attached to the front-end face 19. The support 21 is formed by combining a ring member 23 with a base plate 22 into one body at a front face of the base plate. The base plate 22 is formed by shaping the front-end outer periphery of a cylinder into a flange shape. The ring member 23 has a plurality of pawls 24 that are formed in an inner periphery. The base plate 22 is insert-molded in the front-end face 19. On the other hand, a wound metal band 25 is fixed by welding tab pieces 26 on both ends at a lower side of the arc tube 2 on an outer periphery of the arc tube 2 in the vicinity of the back end portion. It is made possible to place the metal band 25 closer to the back end portion of the arc tube 2 as a result of forming the front-end face 19 at the front-end edge of the inner cylindrical section 17 to be substantially flush with the front-end face 20 of the flange 18. The arc tube 2 is secured to the arc tube support plug 7 by clamping the metal band 25 of the arc tube 2 with the pawls 24 of the support 21.

On the other hand, the lead support wire 8 that extends in parallel with the central axis L0 is disposed below the arc tube 2. One end of the lead support wire 8 is secured in an insertion opening 28 that opens in the front-end face 20 of the arc tube support plug 7, and the other end that bends upward is connected to the lead wire 12 that extends from the front end of the arc tube 2. A cylindrical insulating sleeve 29 is disposed on the outer periphery of the lead support wire 8 that is disposed in parallel with the arc tube 2. The tab piece 26 of the metal band 25 is disposed below the arc tube 2 so as to face the lead support wire 8, and therefore does not block the incident light from the luminous tube into the reflector that is disposed to the rear of the luminous tube obliquely above the luminous tube.

In the base end section 16 of the arc tube support plug 7, a metal terminal 31 is disposed on the outer periphery of an inner cylinder that extends backward from a back side of a bottom section 30 of the inner cylindrical section 17. The lead wire body 13 that extends from the back end portion of the arc tube 2 is connected to the metal terminal 31. A reflector 32 that reflects forward the incident light that is emitted from the luminous tube 9 obliquely upward to the rear side is mounted on the flange 18 of the arc tube support plug 7.

The difference between the discharge lamp bulb of JP 2003-123630 A (discharge lamp device; see FIG. 2 of JP 2003-123630 A) that is a background art shown in FIG. 3 and the discharge lamp bulb 1 of the first embodiment that is shown in FIG. 2 of the present application will be described in order with reference to FIG. 2 and FIG. 3.

Figure 3:
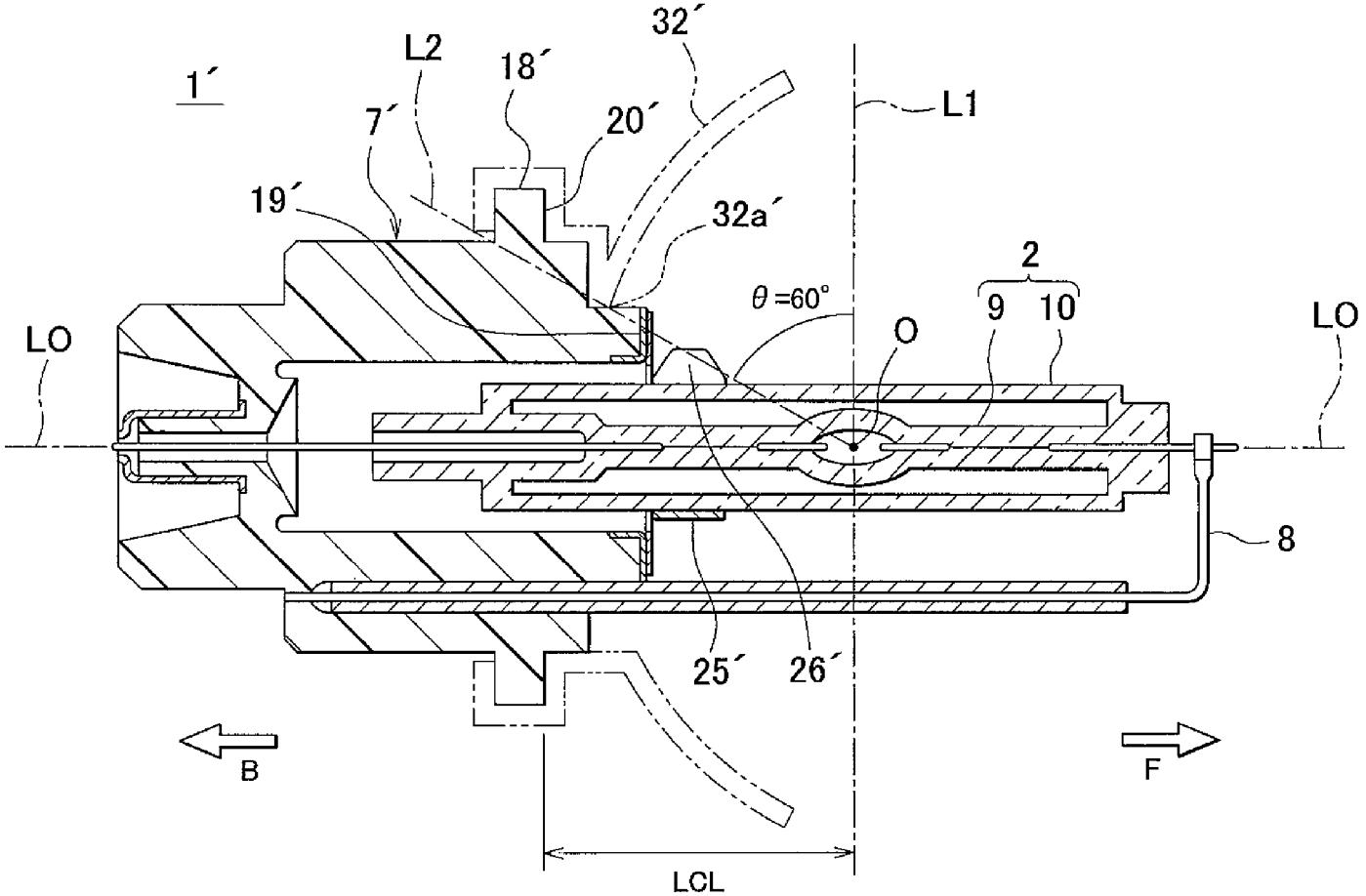
FIG. 3 PRIOR ART
FIG. 3 is a longitudinal section of a discharge lamp bulb, in which the length of an arc tube (length of LCL in the drawing) is shortened in a conventional arrangement of an insulating plug and a tab piece.

First, the discharge lamp bulb 1' of FIG. 3 is formed such that the length LCL from the front-end face 20' of the flange 18' as the attachment reference surface of the bulb to a luminescent center O of the discharge lamp bulb 1' (hereinafter merely referred to as LCL) is changed, to 18 mm, from 27.1 mm that is generally used in the conventional discharge lamp bulb as disclosed in JP 2003-123630A, that is, the length is reduced by about 9 mm as compared to the conventional device.

The discharge lamp bulb 1 of FIG. 2 has common structures to the discharge lamp bulb 1', except that the shape of the arc tube support plug 7 and the position of the tab piece 26 of the metal band are different from those of the discharge lamp bulb 1' of FIG. 3. Specifically, the front-end face 19 at the front-end edge portion of the arc tube support plug 7 of FIG. 2 is formed to be substantially flush (within a range of 0 to 2 mm) with the front-end face 20 of the flange 18, which is different from the front-end face 19' of FIG. 3 that is formed so as to protrude forward from the front-end face 20' of the flange 18' in a stepped shape. In addition, the tab piece 26 of the metal band 25 of FIG. 2 is disposed below the arc tube 2 to face the lead support wire 8, and is therefore different from the tab piece 26' of the metal band 25' of FIG. 3 that is disposed above the arc tube 2. The innermost edge of the reflector 32 of FIG. 2 is disposed closer to the central axis L0 than that of the reflector 32' of FIG. 3.

As a result of shortening the length LCL, the distance from the luminescent center O of the luminous tube 9 shown in FIG. 2 and FIG. 3 to the attachment reference surface of the bulb (the front-end face 20' of the flange) becomes shorter than that in the discharge lamp bulb of JP 2003-123630A.

The amount of light reflected by the reflector (32, 32') of FIG. 2 and FIG. 3 becomes larger as an angle θ that is formed by a straight line L1 passing through the luminescent center O and perpendicular to the central axis L0 of the outer tube 10 and a straight line (L2, L4) passing through the luminescent center O and the innermost edge (32*a*, 32*a'*) of the reflector (maximum incident angle of the light that goes from the luminescent center toward the reflector) becomes larger.

In the discharge lamp bulb 1' of FIG. 3, the reflector 32' and the arc tube 2 is integrally formed with the arc tube support plug 7' in order to obtain the minimum amount of light by setting the aforementioned angle θ to 60°. However, in the discharge lamp bulb 1', as a result of arranging the luminescent center O close to the front-end face 19' of the arc tube support plug 7', the tab piece 26' and the front-end face 19' exist on the straight line L2, and therefore part of the incident light from the luminescent center O to the reflector 32 is blocked by the tab piece 26' and the front-end face 19'.

The table of FIG. 4 shows measurement values of luminous fluxes when the same reflector is used in all measurements. In the measurement, although the angle θ is set equal to 70° in the case of a sample of the bulb of FIG. 2, the luminous fluxes and luminous intensity are compared among the conventional discharge lamp bulb that has a long LCL of 27.1 mm as disclosed in JP 2003-123630 A and the discharge lamp bulbs of FIG. 3 and FIG. 2 where the LCL is shortened to 18 mm. The comparisons of the luminous fluxes and the luminous intensity are conducted in both cases where power consumption is maintained to 35 W that is the same as the conventional technique and reduced to 25 W. In the table, a bulb luminous flux is a measurement value of the luminous flux of the light emitted from the bulb, a lamp luminous flux is a measurement value of the luminous flux of the light reflected by the reflector, and the center luminous intensity is a measurement value of the luminous intensity in a center position of a light distribution pattern.

When the conventional discharge lamp bulb that has a long LCL of 27.1 mm (hereinafter, merely referred to as a conventional bulb) and the discharge lamp bulb of FIG. 3 where the LCL is shortened to 18 mm with respect to the conventional discharge lamp bulb (hereinafter, merely referred to as a bulb of FIG. 3) are compared with reference to FIG. 4, the bulb luminous flux of the bulb of FIG. 3 decreases, in the case of 35 W, from 3200 (lm) to 2970 (lm) as compared to that of the conventional bulb and, in the case of 25 W, from 2150 (lm) to 1990 (lm) as compared to that of the conventional bulb. In either case, the bulb luminous flux decreases by about 7%. On the other hand, the lamp luminous flux of the bulb of FIG. 3 decreases, in the case of 35 W, from 1100 (lm) to 900 (lm) that is about 18% decrease as compared to that of the conventional bulb and, in the case of 25 W, from 740 (lm) to 600 (lm) that is about 19% decrease as compared to that of the conventional bulb. Furthermore, the center luminous intensity of FIG. 3 decreases, in the case of 35 W, from 69000 (cd) to 50000 (cd) as compared to that of the conventional bulb and, in the case of 25 W, from 44160 (cd) to 31900 (cd) as compared to that of the conventional bulb. In either case, the center luminous intensity decreases by about 28%. It is considered that these decreases are because the light from the luminescent center O incident on the reflector 32 and the light reflected by the reflector 32 are blocked by the tab piece 26' and the front-end face 19'.

In order to control such a decrease in the luminous flux and the luminous intensity, in the discharge lamp bulb 1 of FIG. 2 according to the first embodiment, the front-end face 19 at the front-end edge portion of the inner cylindrical section 17 of the arc tube support plug 7 is retracted to the position where the front-end face 19 becomes substantially flush with the front-end face 20 of the flange 18, and the tab piece 26 of the metal band 25 is disposed below the arc tube 2, and therefore the front-end face 19 and the tab piece 26 are designed so as not to block the light whose incident angle is θ=60°. In addition, in the case of the first embodiment, the discharge creepage distance is increased by disposing the tab piece 26 away from an effective reflecting surface that is positioned in the upper side of the reflector 32 and the withstand voltage is improved.

The straight line L3 of FIG. 2 passes through the luminescent center O and the front-end edge 25*a*" of the metal band 25 when the metal band 25 is arranged at the same position in the longitudinal direction as that in FIG. 3 and the tab piece 26 is directed downward (see imaginary line). The angle between the straight lines L1 and L3 is 60°. The light whose incident angle is θ=60° is incident on the reflector 32 without being blocked by the front-end edge 25*a*" in the case that the metal band 25 is disposed at the same position as that in FIG. 3 with the tab piece 26 directed downward.

In the first embodiment, since the front-end face 19 of the arc tube support plug 7 is substantially flush with the front-end face 20, the metal band 25 is disposed further rearward than in the case shown in FIG. 3, and a back-end edge 25*b* is disposed to be substantially flush with a surface that includes the front-end face 20 of the flange 18. The straight line L4 of FIG. 2 passes through the luminescent center O and the front-end edge 25*a* of the metal band 25. In the discharge lamp bulb 1 of the first embodiment, the metal band 25 is mounted on the arc tube 2 so that the angle between the straight lines L1 and L4 becomes 70°. In the discharge lamp bulb 1 of the first embodiment, the front-end face 19 of FIG. 2 does not protrude forward unlike the front-end face 19' of FIG. 3, and therefore it is possible to place the innermost edge 32*a* of the reflector 32 of FIG. 2 closer to the central axis L0 than the innermost edge 32*a'* of the reflector 32' of FIG. 3. As a result, in the discharge lamp bulb 1 of FIG. 2, the light whose incident angle is θ=70° is incident on the reflector 32 without being blocked by the front-end edge 25*a*. That is, in the first embodiment, even when the maximum incident angle θ of the light that is directed to the reflector 32 is designed to be 60° through 70°, the light is less blocked.

When the conventional discharge lamp bulb that has a long LCL of 27.1 mm (hereinafter, merely referred to as a conventional bulb) and the discharge lamp bulb of FIG. 2 where the LCL is shortened to 18 mm (hereinafter, merely referred to as a bulb of FIG. 2) are compared with reference to FIG. 4, the bulb luminous flux of the bulb of FIG. 2 decreases, in the case of 35 W, only from 3200 (lm) to 3120 (lm) as compared to that of the conventional bulb and, in the case of 25 W, only from 2150 (lm) to 2100 (lm) as compared to that of the conventional bulb. In either case, the bulb luminous flux decreases by about 2% only. Further, the lamp luminous flux of the bulb of FIG. 2 decreases, in the case of 35 W, from 1100 (lm) to 1080 (lm), which is a reduction of only about 2% as compared to that of the conventional bulb and, in the case of 25 W, from 740 (lm) to 730 (lm), which is a reduction of only about 1% as compared to that of the conventional bulb. Moreover, the center luminous intensity of the bulb of FIG. 2 decreases, in the case of 35 W, from 69000 (cd) to 68800 (cd), which is a reduction of only about 0.3% as compared to that of the conventional bulb and, in the case of 25 W, from 44160 (cd) to 44000 (cd), which is a reduction of only about 0.4% as compared to that of the conventional bulb. In the discharge lamp bulb 1 of FIG. 2 as described above, the blocking of light by the front-end face 19 and the tab piece 26 is prevented, and the maximum incident angle of the light that is directed to the reflector 32 is designed to be 60° through 70°. As a result, the decrease in the luminous fluxes and the luminous intensity is considered to be significantly reduced as compared to the discharge lamp bulb 1' of FIG. 3.

In some countries, it is mandatory under laws and regulations that the vehicle headlight that produce the luminous flux with specified value or more is equipped with a headlight cleaner. According to the discharge lamp bulb 1 of FIG. 2 in which the power consumption is reduced to 25 W, since the luminous flux of the discharge lamp bulb is reduced to the specified value or lower, there is no obligation to equip the headlight with the headlight cleaner, and therefore the cost of the light that uses the discharge lamp bulb is reduced.

Figure 5:
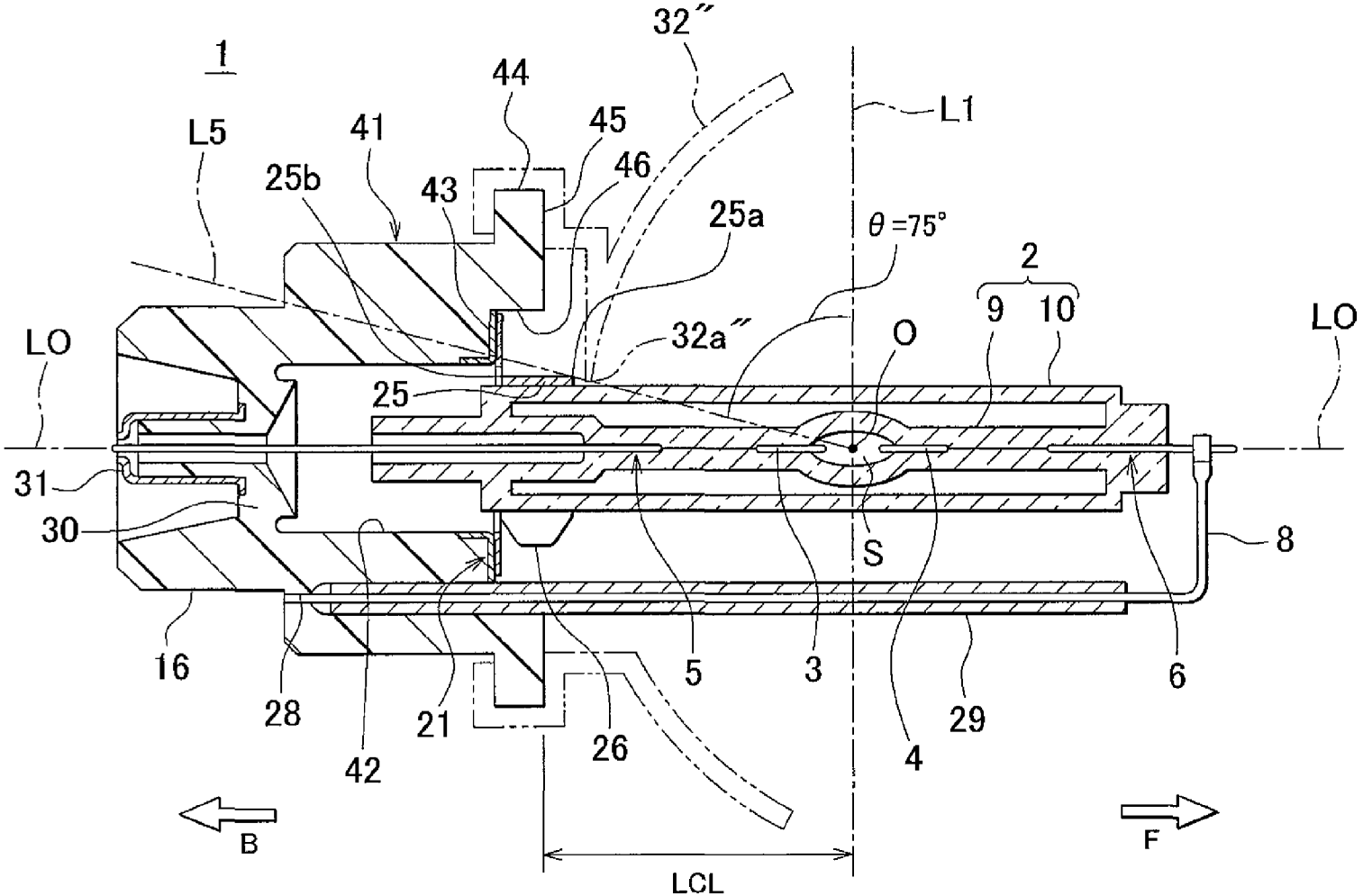
FIG. 5 is a side view of a discharge lamp bulb of a second embodiment.

With reference to FIG. 5, a second embodiment of the discharge lamp bulb will be described next. The discharge lamp bulb 40 of the second embodiment has common structures to the discharge lamp bulb 1 of the first embodiment, except that the shape of the arc tube support plug 41 and the installation position of the metal band 25 are different from those of the discharge lamp bulb 1 that is shown in FIG. 2.

In the arc tube support plug 41, the front-end face 43 at a front-end edge portion of the inner cylindrical section 42 is formed, unlike the arc tube support plug 7, in the stepped manner on the back-end side (within the range of 0 through 0.5 mm) with respect to the front-end face 45 of the flange 44. A large opening 46 that has a larger cross-section than that of the inner cylindrical section 42 is formed radially inside the flange 44 in communication with the inner cylindrical section 42.

The metal support 21 that supports the arc tube is attached to the front-end face 43 at a front-end edge of the inner cylindrical section 42. The metal band 25 and the tab piece 26 that is disposed below the arc tube 2 are inserted into the large opening 46 and therefore attached further closer to the back end portion of the arc tube 2 as compared to the first embodiment. In this case, the back-end edge 25*b* of the metal band 25 is disposed to be substantially flush with a surface that includes the front-end face 43 of the inner cylindrical section 42.

In the discharge lamp bulb 40 of the second embodiment, the front-end face 43 of the inner cylindrical section 42 is positioned on the back-end side with respect to the front-end face 45 of the flange 44. As a result, the front-end face 43 of the arc tube support plug 41 is formed away from the luminescent center O as compared to the front-end face 19 of the first embodiment, and it is possible to attach the metal band 25 at the position that is further away from the luminescent center O to the back-end side of the arc tube support plug 41 and receives less heat while the lamp is emitting light, which reduces generation of gas.

The straight line L5 of FIG. 5 passes through the luminescent center O and the front-end edge 25*a* of the metal band 25. In the discharge lamp bulb 40 of the second embodiment, the metal band 25 is mounted on the arc tube 2 so that the angle between the straight lines L1 and L5 becomes 75°. As a result, in the discharge lamp bulb 40, the light whose incident angle is θ=75° is not blocked by the front-end edge 25*a*. Therefore, in the discharge lamp bulb 40, when the reflector 32" in which the innermost edge 32*a*" is arranged further closer to the central axis L0 than that of FIG. 2 is employed, it is possible to obtain further more reflected light (the lamp luminous flux and the center luminous intensity).

The discharge lamp bulb may be constructed such that the maximum incident angle of light incident on the reflector that is disposed to the rear of the luminous tube obliquely above the luminous tube without being blocked by the front-end edge of the metal band (an angle θ that is formed by a straight line L4 passing through a luminescent center O of the luminous tube 9 and the front-end edge 25*a* of the metal band 25 and a straight line L1 passing through the luminescent center O and perpendicular to a central axis L0 of the luminous tube 9 as shown in FIG. 2) falls within a range from 60° to 75°.

With this configuration, the light emitted from the luminescent center of the luminous tube to the reflector is made possible to be incident on the reflector that is disposed to the rear of the luminous tube obliquely above the luminous tube, at an incident angle within a range from 60° to 75°.

The metal band may have a tab piece that is a joint portion protruding from each end of the metal band and be mounted on the outer periphery of the outer tube by joining the tab pieces together, and the tab pieces may be positioned on a side surface of the outer tube that faces the lead support wire. The tab pieces of the arc tube may be provided so as to protrude at a position such that the tab pieces are opposed to the lead support wire.

When the tab piece (welding part) of the metal band that is held by the support portion of the arc tube support plug is disposed at a position (lower position) that faces the lead support wire instead of on an upper section of the arc tube, the light emitted from the luminescent center of the luminous tube toward the reflector is incident on the reflector that is disposed to the rear of the luminous tube obliquely above the luminous tube, without being blocked by the tab pieces of the metal band. In particular, when the tab pieces of the metal band are disposed at a position such that the tab pieces are opposed to the lead support wire, it is possible to further reduce the influence of the tab pieces on the luminous flux from the luminescent center to the reflector.

In the discharge lamp bulb of the invention, the back-end edge of the metal band may be positioned to be substantially flush with a plane that includes the front-end face at the front-end edge of the inner cylindrical section.

According to the aforementioned structure, even if the size of the discharge light bulb is reduced by shortening the length in which the arc tube protrudes from the arc tube support plug, the amount of light reflected by the reflector is maintained adequately.

In the discharge lamp bulb of the invention, the back-end edge of the metal band may be positioned on the back-end side with respect to a plane that includes the front-end face of the flange.

According to the aforementioned structure, since the front-end edge of the inner cylindrical section and the mounting position of the metal band in the arc tube support plug is further away from the luminescent center, temperature of the arc tube support plug and the metal band is less prone to become high when the discharge lamp bulb is lit, and gas becomes less prone to be generated.

As described above, according to the discharge lamp bulb of the invention, a small discharge lamp bulb, in which the amount of light reflected by the reflector is adequately maintained even if the arc tube is shortened, is obtained, and therefore it is possible to reduce the size and the weight of the light that uses the discharge lamp bulb of the present application. In addition, discoloration of the reflector due to the gas is prevented.

When the back-end edge of the metal band is positioned on the back-end side with respect to the plane that includes the front-end face of the flange, discoloration of the reflector due to the gas is further prevented.

The invention has been described with reference to example embodiments for illustrative purposes only. It should be understood that the description is not intended to be exhaustive or to limit form of the invention and that the invention may be adapted for use in other systems and applications. The scope of the invention embraces various modifications and equivalent arrangements that may be conceived by one skilled in the art.

What is claimed is:

1. A discharge lamp bulb comprising an arc tube including:

a luminous tube, both ends of which are sealed;

a pair of electrodes that are disposed inside the luminous tube so as to be opposed to each other;

an outer tube that has the luminous tube therein and both ends of which are sealed;

a pair of lead wires that are connected to the pair of electrodes and respectively extend outward from ends of the outer tube in a longitudinal direction of the discharge lamp body; and a metal band that is mounted on an outer periphery of the outer tube, an arc tube support plug including:

a plug body having a hollow, inner cylindrical section that is formed inside the plug body and that opens at a front end;

a support portion that is mounted on a front-end edge of the inner cylindrical section and supports the arc tube by holding the metal band; and a flange for mounting a reflector, and a lead support wire extending outside the outer tube in the longitudinal direction and connecting one of the pair of lead wires with the arc tube support plug, wherein a front-end face at the front-end edge of the inner cylindrical section is substantially flush with a front-end face of the flange or is positioned on a back-end side with respect to the front-end face of the flange;

an angle that is formed by a straight line passing through a luminescent center of the luminous tube of the arc tube and a front-end edge of the metal band of the arc tube and a straight line passing through the luminescent center of the luminous tube of the arc tube and perpendicular to a central axis of the luminous tube of the arc tube falls within a range from 60° to 75°.

2. The discharge lamp bulb according to claim 1, wherein the metal band has a tab piece that is a joint portion protruding from each end of the metal band and is mounted on the outer periphery of the outer tube by joining the tab pieces together, and the tab pieces are positioned on a side surface of the outer tube that faces the lead support wire.

3. The discharge lamp bulb according to claim 2, wherein the tab pieces of the arc tube are provided so as to protrude at a position such that the tab pieces are opposed to the lead support wire.

4. The discharge lamp bulb according to claim 1, wherein a back-end edge of the metal band is positioned to be substantially flush with a plane that includes the front-end face at the front-end edge of the inner cylindrical section.

5. The discharge lamp bulb according to claim 1, wherein a back-end edge of the metal band is positioned on a back-end side with respect to a plane that includes the front-end face of the flange.

* * * * *